US006352215B1

(12) United States Patent
Cash et al.

(10) Patent No.: US 6,352,215 B1
(45) Date of Patent: Mar. 5, 2002

(54) PAYOFF DEVICE FOR A REELESS PACKAGE

(75) Inventors: John Wilson Cash, Powder Springs; Michael F. Flagg, Newnan; James Wilburn Langston, Temple; David Warren Windom, Mt. Zion, all of GA (US)

(73) Assignee: Southwire Company

( * ) Notice: Subject to any disclaimer, the term of this patent is extended or adjusted under 35 U.S.C. 154(b) by 0 days.

(21) Appl. No.: 09/500,679

(22) Filed: Feb. 9, 2000

(51) Int. Cl.[7] ..... B65H 16/04; B65H 75/24

(52) U.S. Cl. ..... 242/574.2; 242/578; 242/578.2; 242/592; 242/594.3; 242/597.4

(58) Field of Search ..... 242/574.2, 574.4, 242/591, 592, 597.4, 594.3, 399.2, 399.1, 396.9, 423, 423.1, 578.2, 578, 574, 574.3, 557, 597.8, 407.1, 574.1

(56) References Cited

U.S. PATENT DOCUMENTS 2,127,772 A * 8/1938 Horn et al. ..... 242/597.4
2,202,883 A * 6/1940 Yoder ..... 242/574.4
2,370,868 A * 3/1945 Luebke ..... 242/574.2
2,529,185 A * 11/1950 Proctor ..... 242/597.4
2,875,962 A * 3/1959 Lanstrom ..... 242/574.4
2,949,252 A * 8/1960 Schumann et al. ..... 242/591
2,971,721 A * 2/1961 Jones ..... 242/574.1
2,983,465 A * 5/1961 Skubal ..... 242/591
3,022,024 A * 2/1962 Tishken ..... 242/591
4,798,349 A * 1/1989 Manservisi ..... 242/574.2
5,285,976 A * 2/1994 Schmid et al. ..... 242/557
5,725,175 A * 3/1998 Thundathil ..... 242/594.3

* cited by examiner

*Primary Examiner*—John M. Jillions
(74) *Attorney, Agent, or Firm*—Herbert M. Hanegan; Dale Lischer; Eric J. Hanson

(57) ABSTRACT

This invention relates to a payoff device particularly suited for coiled wire which is packaged without a reel. The device includes a clamp assembly rotatably supported at one end by a frame which may be affixed to a truck or other vehicle. The clamp assembly has a mandrel featuring a plurality of clamp pads connected to a main rotatable shaft by a scissors linkage which may be stationary or may push the pads in a radial direction against the interior surface of the coiled wire. Two end plates support the coil laterally and one of the end plates is removable so that the coil can be placed on the clamp assembly. The clamp assembly is supported by a frame whose upper portion is rotatable such that the payoff direction can be changed. The device also includes a brake and a stop pin to prevent unwanted rotation of the clamp assembly and a locating pin to prevent the unwanted rotation of the upper portion of the support frame.

27 Claims, 11 Drawing Sheets

PAYOFF DEVICE FOR A REELESS PACKAGE

FIELD OF THE INVENTION

The present invention relates to a payoff device for use with a reeless package such as a reeless wire or cable coil which is particularly well suited for mounting on a utility truck such that a reeless package of material may be easily, conveniently, and safely unwound in the field.

BACKGROUND OF THE INVENTION

Devices for insertion into the hollow core of a roll or coil of material to support the roll or coil and to facilitate unwinding are known. It is also known in the art to use an adjustable device to facilitate initial insertion into a roll core prior to clamping expansion or to accommodate rolls or coils with different inside diameters through various degrees of expansion. There is also known in the art expandable and collapsible holders about which material is wrapped while the holder is in an expanded state. Examples of expandable and collapsible holders or mandrels can be found, for instance, in U.S. Pat. Nos.: 1,466,153; 2,682,924; 2,762,577; 3,918,659; 4,124,171; 4,278,112; 4,763,850; 4,995,569; and 5,318,236.

There is also know in the art support stands for use in the dispensing or holding of wound material as represented by U.S. Pat. Nos. 1,807,549; 3,918,659 and 5,810,283.

Rolls of electrical wire or cable such as those used in the field by electric utilities and the like for installation and repair often are relatively heavy (e.g., 1,500 lbs) and can be cumbersome to handle and payoff. These rolls of wire or cable used by utility companies in the field are wound onto wooden reels and typically there is a frame mounted in the truck bed of the utility vehicle for supporting the wooden reel. The wire or cable wrapped on the wooden reel is then transported in the field for unwinding by pulling on an end of the wire thereby rotating the reel on which it is wound. The extra weight and material associated with the wooden reel with rolled material introduces added production and shipping costs for the manufacturer of the rolls as well as handling and disposal costs for the utility company or the like dispensing the rolled material. The wooden reels also take up a lot of room in the truck bed thus limiting space which could be put to other use such as providing additional storage space for coil material or tooling to prolong the time out in the field. Furthermore, the use of such wooden reels is detrimental to the environment by causing trees to be consumed and taking up space in landfills after their useful life.

In addition, under current practice reels are mounted in trucks on support frames that are not multi-positional with respect to the supporting truck bed (e.g support frameworks that are non-rotatable about a vertical axis). For example, many prior art support frames have two spaced apart support structures each rigidly secured to the bed of the truck for supporting opposite ends of a shaft about which the reel or spool is rotated during payoff. This arrangement makes the device ill suited for any repositioning of the support structure. Thus, a worker in the field must reposition the entire truck in order to adjust the direction of payoff. This can be very difficult if there are obstacles which hinder the movement of the truck and can be dangerous if it forces a truck into an unstable position or in a position which interferes with others, such as by blocking street traffic. There also arises situations wherein it would be beneficial to be able to provide for loading of new cable or wire or the like in a certain orientation which is not possible in non-adjustable prior art reel support frame structures.

There is need in the art for a reeless package payoff device which is durable, not overly complex (but yet highly versatile), safe and easy to both load and operate in a dispensing mode and which is well suited for use in the field such as on the back of a utility truck or the like or on a transported trailer.

SUMMARY OF THE INVENTION

According to the present invention, there is provided a reeless package payoff device and method of operation of the same which avoids many of the limitations of the prior art devices in providing a highly versatile and easy to operate system that is well suited for field use such as on the back of utility vehicles or the like. Preferably the reeless package payoff device comprises a clamp assembly that is supported by a main shaft rotatably mounted in bearings of a support frame structure such that the clamp assembly and shaft rotate together. A preferred arrangement features a main shaft which is supported on one of its ends by bearings that are spaced apart along the end portion of the shaft to a sufficient extent based on the anticipated loads. The support frame structure that supports the main shaft is preferably, itself, multi-positionable to provide for different payout orientations such as by way of an upper support framework portion that pivots with respect to a non-rotatable lower portion. The support frame is attached to the bed of a utility truck or other vehicle, preferably by way of releasable attachment means which securely fastens the lower portion of the support frame to the bed or the truck or other suitable underlying support and provides for removal of the support structure from the underlying support when not required or in use.

The clamp assembly preferably comprises first and second hubs axially spaced along the main shaft. Each hub is connected so as to rotate together with the main shaft with a preferred embodiment featuring a fixed hub and an axially mobile hub with the latter being keyed to the main shaft so as to rotate therewith, but free to axially adjust along the main shaft by way of a key/slot arrangement. The clamp assembly further comprises clamp pads (e.g., 4) that are driven radially in and out by an expansion/contraction device such as a plurality of scissor linkage assemblies to which the clamp pads are respectively attached. The scissor linkage assemblies feature scissors linkage that are pivotably attached at their radial outer end to a support structure of the clamp pads, are pivotably joined together at an intermediate area and are further pivotably attached at respective radial interior ends to the axially spaced apart mobile hub and fixed hub. The mobile hub is moveable axially such that, upon movement toward the fixed hub, it causes the scissors linkage to move the clamp pads radially outward into compressive attachment contact with the interior surface of a reeless package placed on the clamp assembly. Alternatively, the clamp assembly may have clamp pads attached to fixed arms. Such an arrangement allows rotation with a variable ID with the variation limited mainly by the escentricity of the coil or roll package. The advantages of this are that no manual lifting of the coil is required, less torque is needed, there is no movement of the arms circumferencially inside the coil, thereby preventing damage to the coil by scraping, marring, etc., and there is less wear on pivot parts. When it is desired to remove a reeless package or replace a completely paid out reeless package, the previously expanded clamp assembly can be collapsed in a controlled fashion to a suitable state to receive a replacement reeless package having a similar or smaller sized interior diameter. Alternatively, if the replacement reeless package has a larger interior diameter than the previous reeless package and the prior reeless package was completely paid out, then the replacement package can be simply inserted over the earlier expanded clamp pads and the clamp pads further moved radial out by moving the mobile hub even closer to the fixed hub until the replacement reeless package is fixed with respect to the clamp pads. Thus, the above described preferred embodiment of the clamp assembly of the present invention can quickly and accurately conform to a variety of different diameter reeless packages which was not the case with the non-adjustable wooden reel support payoff devices in the prior art. In addition, while the clamp pad assembly is designed for use with reeless packages, the clamp pad assembly of the present invention is versatile enough to handle rolls or coils of material which do have an internal reel or spool or the like, although for the reasons outline above such as weight and volume reduction, reeless packages are preferred for use with the present invention.

The mobile hub is driven or moved axially along the main shaft by a drive assembly which in a preferred embodiment features a driver such as a drive screw threadedly connected to the mobile hub. The drive screw preferably has a central through hole which receives a smaller diameter end extension of the main shaft with the drive screw being held in place axially by a locking collar attached to the free end of the main shaft's smaller diameter end extension and the stepped shoulder of the main shaft leading to the smaller diameter end extension. The drive screw is thus axially retained by the locking collar and stepped shoulder, but free to rotate about the main shaft's smaller diameter end extension with the assistance of a thrust bearing provided axially inward of the locking collar. With this arrangement, the mobile hub is also preferably formed as a cylindrical sleeve with a sufficient diameter to receive and axially slide along the larger diameter portion of the main shaft extending to the stepped shoulder. In a preferred embodiment, the sleeve of the mobile hub is provided with interior threads for engagement with the drive screw's external threads such that, upon rotation of the drive screw, the mobile hub is moved axially along the main shaft either closer to or away from the fixed hub depending on the direction of rotation of the drive screw and the clamp assembly is correspondingly expanded or contracted.

The key/slot connection between the mobile hub and main shaft allows for the axial movement imparted by the drive screw on the mobile hub, while allowing for the mobile hub and main shaft to rotate as a unit in similar fashion to the fixed hub and main shaft combination.

The reeless package (reference will be made to "coil" hereafter for simplicity, but a variety of packages of wound material are suited for use with the clamp assembly of the present invention) is held in place side to side by a fixed end plate and a removable end plate. During loading of the coil, the removable end plate is removed from its coil retention position and a coil of electrical wire, for example, is placed on the clamp assembly. The removable end plate is attachable to the drive screw through locking clamps such that the removable end plate can be rotated by an operator to drive the drive screw. The removable end plate is thus used to drive the drive screw such that the mobile hub is axially moved along the main shaft to cause the clamp pads to come in contact and retain in position the interior surface of the coil. The removable end plate is then moved against the side of the coil and locked into place. An optional locking collar includes a sleeve with staggered holes that is rotated around the drive screw until a hole in the sleeve aligns with a hole in the drive screw. A locking pin is inserted through the sleeve hole and the shaft hole to lock the removable end plate in place. The locking pin may also include a cotter pin or similar safety device to prevent accidental removal of the locking pin. In a preferred embodiment, the locking clamps are designed to be relatively easily released by an operator such that the removable end plate can be shifted from its clamped attachment position on the drive screw (e.g., an enlarged outer end portion of the drive screw) to a clamped attachment position on the mobile hub's (e.g., an exterior portion of the mobile hub having a similar diameter as the enlarged outer end portion of the drive screw). Also, the clamp pads supported on the clamp assembly have an axial length suited for contact and retention of a wide variety of different width reeless packages and to provide for end-to-end clamping of both relatively small width and large width packages. This versatility in full support of different width coils is facilitated by having the end plates provided with radially interior, circumferentially spaced slots that are sized to axially receive therethrough the ends of the clamp pads and also to allow for a full range of expansion and contraction in the radial direction.

The device is also equipped with a manually adjustable brake and a stop pin to orient and prevent rotation of the clamp assembly during loading and clamping. There is also provided a locating pin to prevent rotation of the upper portion of the support frame when the locating pin is inserted through the upper portion and within one of a plurality of circumferentially spaced pin reception holes in a lower portion of the support frame about which the upper portion rotates and preferably is supported by. Thus, with the clamp assembly lock pin and pivoting support locating pin in position, the loading and clamping operations can be performed without undesired rotation of either the clamp assembly or support frame. This also provides locking for transport while the coil is on the truck and for payoff of the coil. Following loading of the coil and positioning of the end plate in its coil retention position, the clamp assembly lock pin is released and the brake (e.g., a spring applied caliper brake) is set (or pre-set) to a desired state to allow for drag adjustment as needed to minimize over spinning following a pay out of material. The clamp assembly brake contact member is an annular ring attached by a plurality of circumferentially spaced bolt sleeves to the hub region of the fixed end plate with at least one hole circumferentially spaced for reception of the clamp assembly locking pin.

The locating pin may also be removed at any desired time so the clamp assembly can be rotated to a desired payoff direction or to a desired coil loading position.

With the foregoing and other advantages and features of the invention that will become hereinafter apparent, the nature of the invention may be more clearly understood by reference to the following brief description of the drawings, the detailed description of the invention, the appended claims and to the several views illustrated in the attached drawings

DESCRIPTION OF THE PREFERRED EMBODIMENTS

Figure 2:
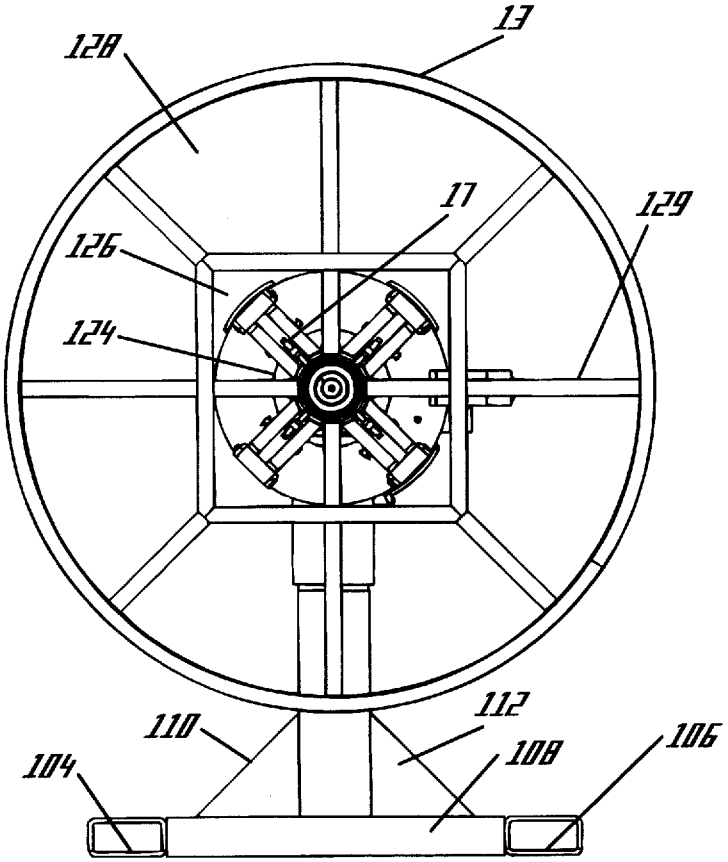
FIG. 2 is a left side elevational view of that which is shown in FIG. 1.
Figure 1:
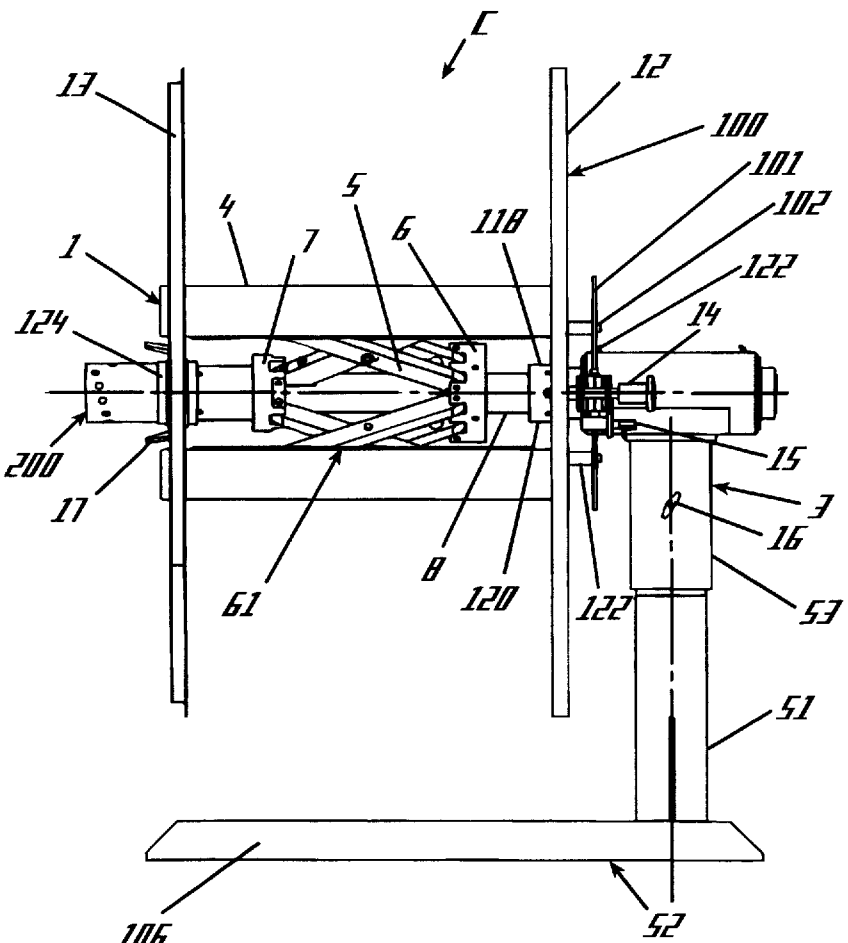
FIG. 1 is a front elevational view of a preferred embodiment of the invention in one of its possible support frame pivot settings.

Referring now to the drawings in detail, FIG. 1 is a front elevational view of a preferred embodiment of the payoff device 100 of the present invention illustration of a wound coil "C" supported thereby. As shown in FIGS. 1 and 2 payoff device 100 comprises clamp assembly 1 and support frame 3 together with removable end plate 13 and preferably fixed end plate 12 and brake assembly 102.

Support frame 3 comprises base 52 from which upwardly extends lower support member 51. Base 52 preferably is formed in U-shaped fashion with a pair of legs 104 and 106 extending in parallel fashion from a main support base section 108. Lower support member 51 is securely joined (e.g., welded) to main support base section 108 with wing extensions 110 and 112 providing additional support and stability. Legs 104 and 106 are preferably tubular in design and spaced apart to conform to the standard spacing of fork lift tines such that the support structure (with the added clamp assembly and other components described above) can be easily lifted up and positioned in the bed of a utility truck or the like or easily moved within a facility (a preferred embodiment, without coil, weighs about 775 lbs preventing easy manual movement). Base 52 is attached to an underlying support (not shown) such as to a truck bed or other vehicle (not shown) by bolts, welding, or other attachment means. Particularly when being used in a transported fashion, it is preferable to have the attachment means as a releasable attachment means such as the above noted bolts to provide for easy redistribution amongst a utility vehicle fleet by way of a forklift truck or the like.

Figure 3:
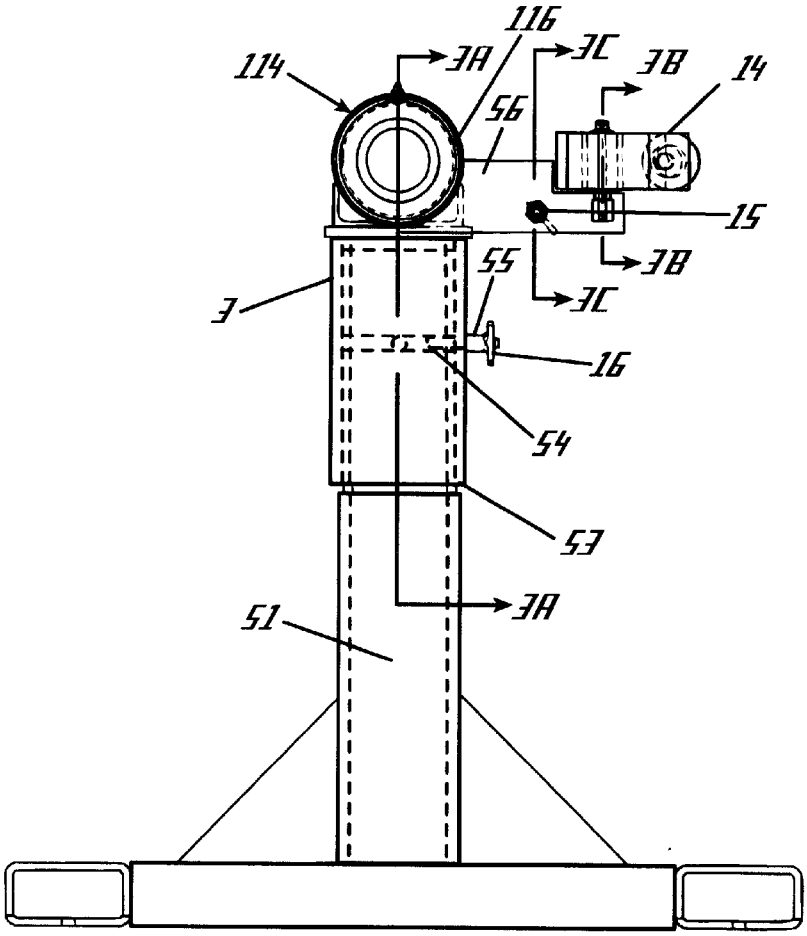
FIG. 3 is a left side elevational view of the support frame (the clamp assembly of FIG. 1 having been removed for added clarity of the support frame structure).
Figure 3A:
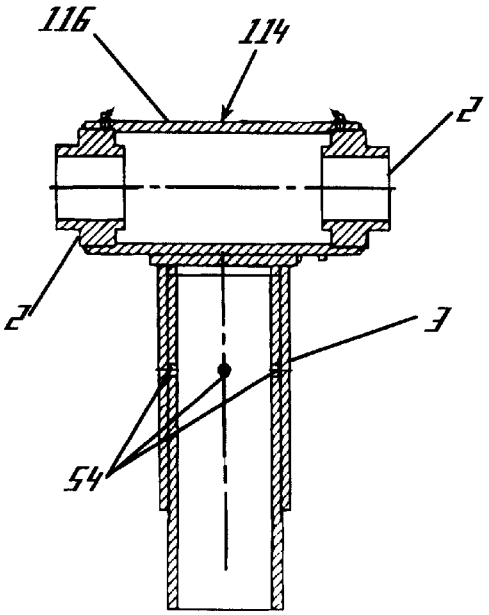
FIG. 3A is a cross-sectional view of the support frame taken along cross-section line A—A in FIG. 3.
Figure 3B:
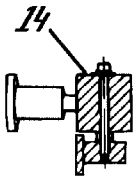
FIG. 3B is a cross-sectional view of the brake assembly taken along cross-section line B—B in FIG. 3.
Figure 3C:
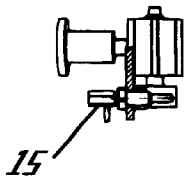
FIG. 3C is a cross-sectional view taken along cross-section line C—C in FIG. 3 showing the brake and clamp assembly locking pin.

The pivotal support sleeve 53 is rotatably supported with respect to the upper portion of vertical support member 51. As shown best in FIGS. 3 and 3A, lower support member 51 preferably extends internally within support sleeve 53 in a slide friction relationship to provide for sleeve pivoting in a stable fashion A removable locating pin 16 is insertable through a hole 55 in the support sleeve and engages a pin tunnel 54 extending through an upper portion of said vertical support member 51 so as to prevent rotation of the pivotal support sleeve 53. The locating pin 16 preferably has a locking detent (e.g. a spring biased bearing (not shown)) to prevent accidental disengagement and unintended rotation of the sleeve. Also as shown in FIG. 3A there are preferably a plurality of circumferentially spaced pin tunnels 54 which allow sleeve 53 to be pivoted and locked in one of a plurality of different payoff orientations. In the illustrated embodiment, four pin tunnels spaced apart by 90° are provided circumferentially around vertical support member 51 to provide multiple locked positions in sleeve 53 although a greater or lesser number can be provided depending on the typical usage requirements.

Bearing support 114 is connected to an upper end of the pivotal support sleeve 53 for rotation therewith and includes cylindrical casing 116 arranged with its central axis extending horizontally and thus transverse to the vertical rotation axis of pivotal support sleeve 53 . At opposite ends of casing 116 there is provided fixed bearings 2 and 2' which receive the supported end of main shaft 8 for rotation with respect to the fixed in position sleeve 53. The bearing arrangement contains set screw bearings which are sufficient to avoid axial shifting of the main shaft within the bearings 2, 2. The axial length of casing 116 and hence the lateral spacing of bearings 2 and 2' is arranged to adequately distribute the loads involved to provide a smooth rotation of the clamp assembly. This arrangement is well suited for handling a wide variety of coil weights including, for example, electrical wire and cable coils such as a reeless coil of "Multiplex" electrical wire and cable having a 19-inch inside diameter, a 42 inch outside diameter and a 28 inch width and generally weighing about 1500 lbs. As shown in FIG. 1 and 2, legs 104 and 106 of base 52 extend in parallel fashion out underneath the clamp assembly for a length that exceeds the axial spacing of end plates 12, 13 and preferably a length equivalent to or greater than the length of the main shaft to help distribute the loads and provide a stable platform with respect to the clamp assembly intended for rotation with the main shaft while supporting coil C. As also shown in FIGS.

1 and 3A, for providing a stable bearing arrangement for loaded rotating shaft 8, the lateral spacing of bearing sleeves 2 and 2' is preferably at least a quarter and more preferably about a third of the length of shaft 8.

A brake 14 for limiting the undesired rotation of the shaft and to act as a torque limiter is attached to a horizontal support member 56. The brake is preferably a manually adjustable caliper brake which includes a brake disc attached directly or indirectly to the main shaft such that friction is applied to the disc thereby slowing rotation of the main shaft. A spring loaded stop pin 15 is used to orient and prevent rotation of the clamp assembly 1 during loading and clamping of a coil. Also, with the above described preferred one end support arrangement of the support framework 3 for the main shaft 8 there is provided a free end of the main shaft and clamp assembly combination which allows for rapid loading of a coil onto a stable clamp assembly. That is with the clamp assembly set at a desired coil receiving contraction state and the removable end clamp removed, the coil can be easily slipped over the free end of the combination main shaft and expansion-contraction assembly with clamp pads for final positioning and retention as described in greater detail below. For example, a reeless coil such as the above noted 1500 lb. "Muliplex" coil which is banded and palletized for shipping purposes can be easily picked up by way of a fork lift or C-hook device which moves the interior of the coil into position about the fixed arms of the clamp assembly or the contracted clamp assembly, as the case may be, lowers the coil into contact with the clamp assembly and then moves into a non-contact state with respect to the coil. The ability to adjust the orientation of the main shaft 8 and upper support frame portion 53 with respect to the lower support frame portion 51 also can greatly facilitate the initial loading by allowing for a clear path loading situation which might not exist in other main shaft orientations.

As shown in FIG. 1, fixed end plate 12 includes a central hub section 118 that is securely fixed to main shaft 8 by way of securement means 120 which can include, for example, a compressive sleeve arrangement (such as that described below for the fixed hub 6), radially extending friction contact securement bolts that abut the exterior surface of the main shaft or bolts or the like that extend into or through reception holes appropriately positioned on main shaft 8. As shown in FIG. 1, the fixed end plate 12 is positioned axially between fixed hub 6 and the interior end of casing 116. As further shown in FIG. 1, end plate 12 supports a plurality of circumferentially spaced bolt/sleeve combinations 122 (e.g., 3 or 4 equally circumferentially spaced combinations) that extend parallel to main shaft 8 at a radially interior section of end plate 12. Bolt/sleeve combinations support at their free end disc 101 which disc is annular in shape and extends about casing 116 and provides a braking contact area radially out from the combinations 122.

Figure 6:
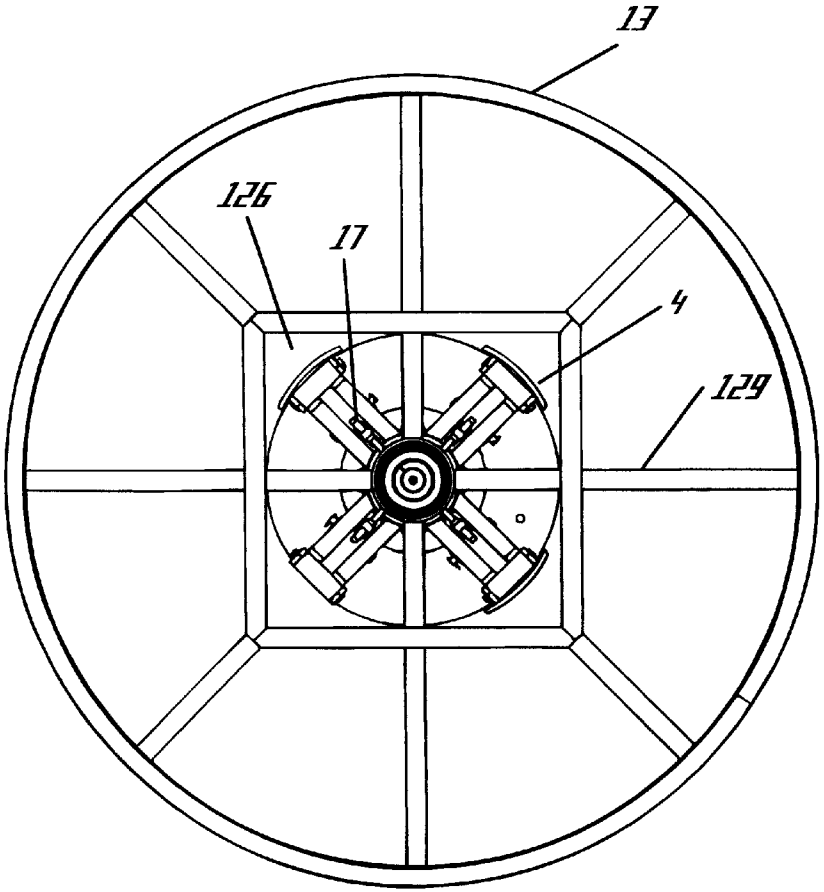
FIG. 6 is a left side elevational view of the clamp assembly (the support frame of FIG. 2 having been removed for added clarity of the clamp assembly structure).
Figure 8:
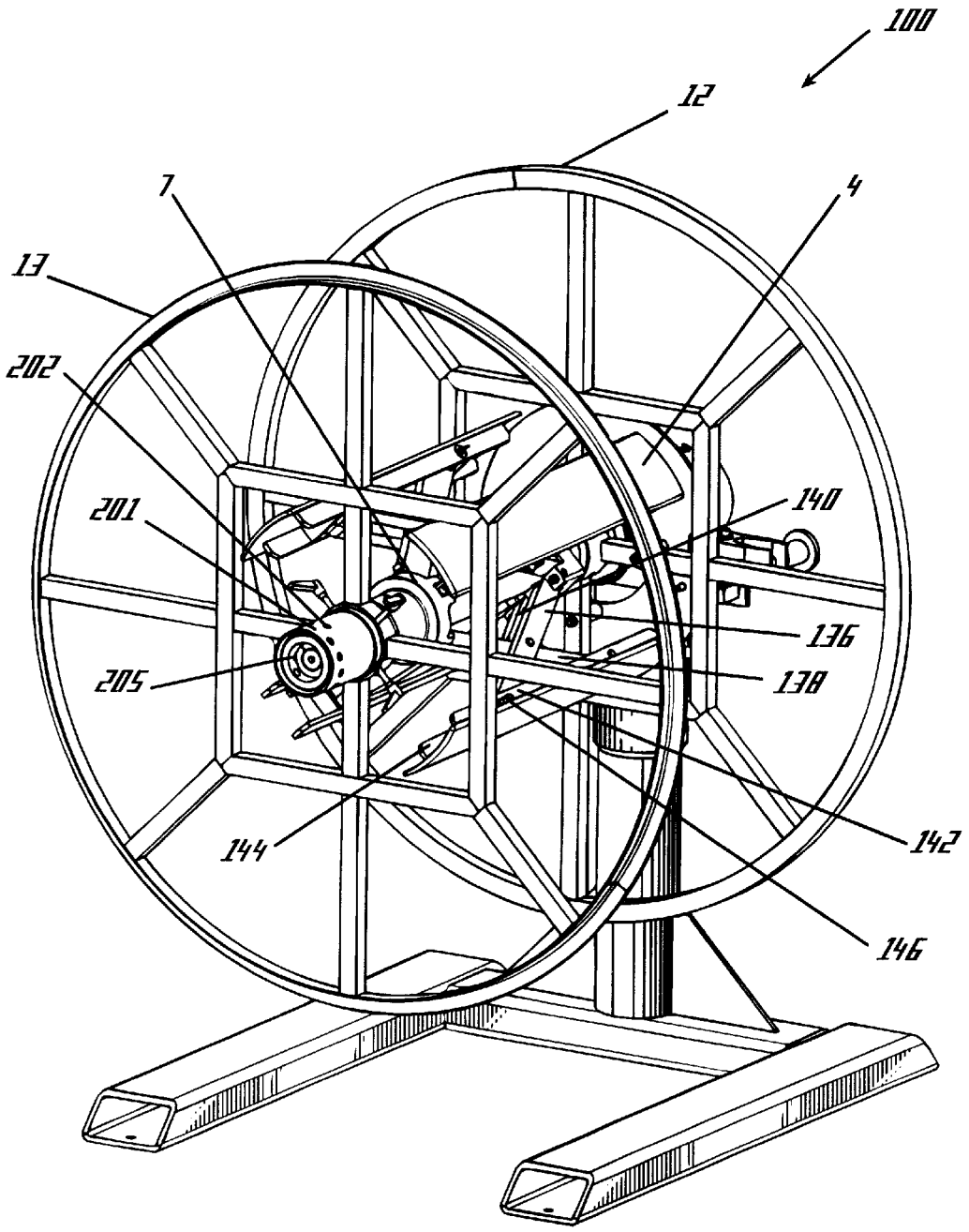
FIG. 8 is a perspective view of a preferred embodiment of the invention in one of its possible support frame pivot settings.

As shown in FIGS. 1 and 2, removable end plate 13 is axially spaced from fixed end plate 12 to provide a coil retention function (preferably to the extent of actual contact with the opposite sides of the coil body). Removable end plate 13 also features an internal hub 124 which, in the position shown in FIG. 2, is releasably mounted on mobile hub 7 by way of locking clamps 17. As shown in FIGS. 2 and 6, removable end plate 13 includes a plurality of circumferentially spaced apart slots 126 which are at least equal in number to the number of clamp pads 4 of clamp assembly 1 and are sized so as to be able to receive there through an end of clamp pads 4 as shown in FIG. 1. As further apparent from FIGS. 1 and 8, fixed end plate 12 also includes similar slots for receiving therethrough the opposite end of clamp pads 4. In addition to their weight reduction function, slots 126 on end plate 13 and the corresponding slots on end plate 12 provide for full width contact by the expandable clamp pads of the internal diameter of the coil for a wide range of coil widths so as to provide for stable securement of a wide variety of coil sizes. Moreover, the radial distance of slots 126 are sufficient to handle the expansion and contraction travel range for the clamp pads which travel is described in greater detail below. Each of end plates 12 and 13 is also provided with radially external slots 128 which form spokes 129 therebetween which are convenient grasping locations for an operator who is spinning removable end plate 13 to either drive in or out the mobile hub by a corresponding rotation of the drive screw.

Figure 4:
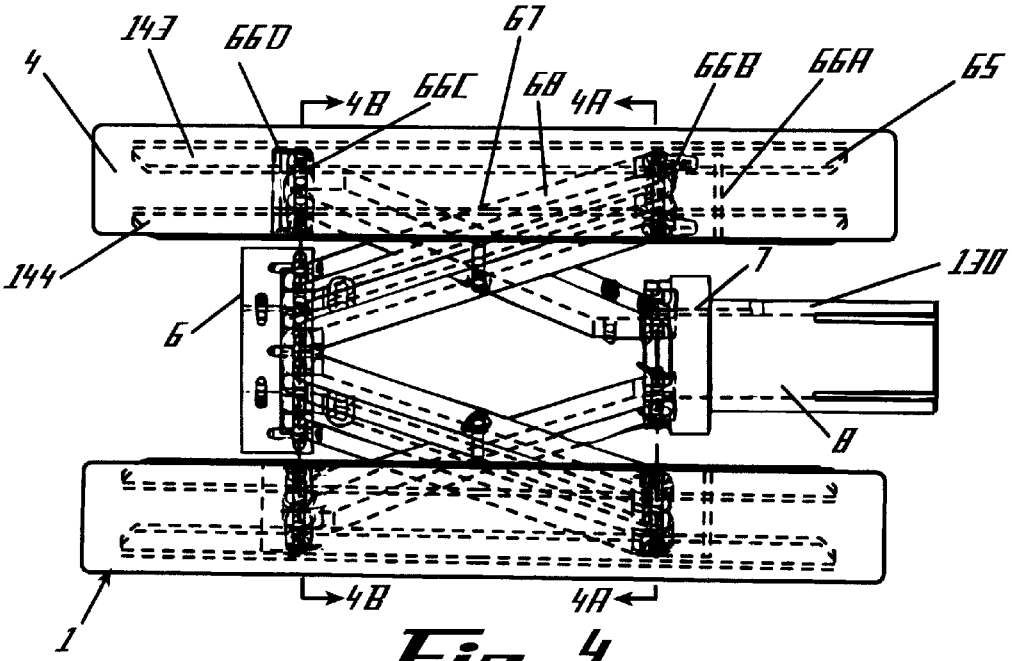
FIG. 4 is a top plan view of the clamp assembly.
Figure 4A:
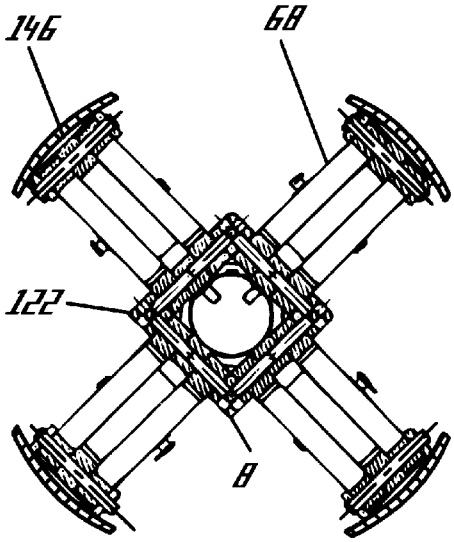
FIG. 4A is a cross-sectional view of the clamp assembly taken along cross-section line B—B in FIG. 4 which extends through the fixed hub.
Figure 4B:
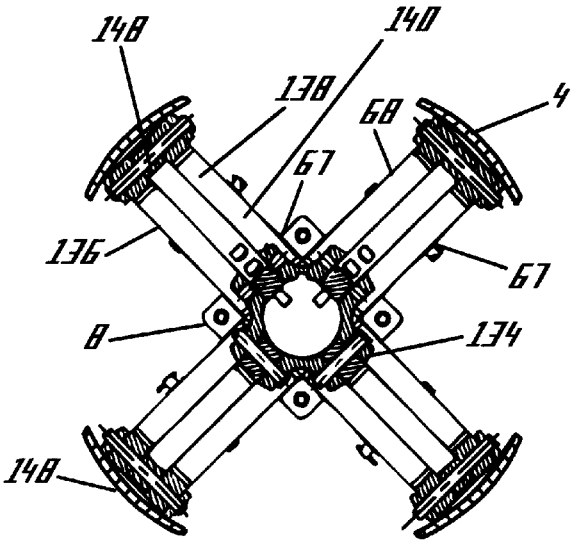
FIG. 4B is a side sectional view of the clamp assembly taken along cross-section line A—A in FIG. 4 which extends through the mobile hub.

With reference to FIGS. 1, 4, 4A–4C, and 5–9, a more detailed discussion of a preferred embodiment of clamp assembly 1 is provided. Clamp assembly 1 comprises main shaft 8 upon which tubular fixed hub 6 is axially fixed to the main shaft and upon which tubular mobile hub 7 is free to axially shift along main shaft 8 while being keyed to the main shaft such that it rotates with the main shaft. As represented by FIGS. 4 and 4A, fixed hub 6 is secured to main shaft 8 by way of suitable fixation means 130 such as retention ring keys, set screws, threaded bolts, and the like. As best shown in FIG. 4A, fixed hub 6 features a multi-sided periphery with the number corresponding to the number of clamp pads 4. Within the multi-sided hub there extends pivot shafts 132 which extend through suitable passageways formed in the body of hub 6 and are held therein. The pivot shafts 132 extend parallel to respective outer side walls of hub 6. As shown in FIG. 4B, mobile hub 7 includes a scissor link reception section with a clover leaf like configuration with each protrusion of the clover leaf having a passageway for receiving and holding in position a pivot shaft 134.

Clamp assembly 1 may contain fixed claim pads 4 or may comprise an expansion/contraction assembly 68 which is represented by a plurality of scissor linkage assemblies corresponding in number to the number of clamp pads 4. A preferred scissor link assembly 68 comprises a pair of outer links 136 and 140 which extend from either a pivot shaft 132 of fixed hub 6 or a pivot shaft 134 of mobile hub to a pivot support location provided on an undercarriage 62 of the clamp pads (described in greater detail below). In the illustrated embodiment of FIG. 4A, the pair of outer links 136 and 140 are received within reception recesses formed in fixed hub 6 and pivotably connected to a corresponding one of the pivot shafts 132. In the embodiment illustrated in FIGS. 4 and 9, the scissor link assemblies further comprise an internal scissor link 138 which extends between outer links 136 and 140 and is received at its radially internal end by a corresponding reception area in mobile hub 7 and pivotably secured thereto by shaft 134. The radial opposite end of internal scissor link 138 is pivotably connected to the undercarriage 62 . The inner scissor link 138 crosses outer scissor links 136 and 140 and the three are pivotably interconnected at the intermediate cross point by way of pivot shaft 67.

Figure 5:
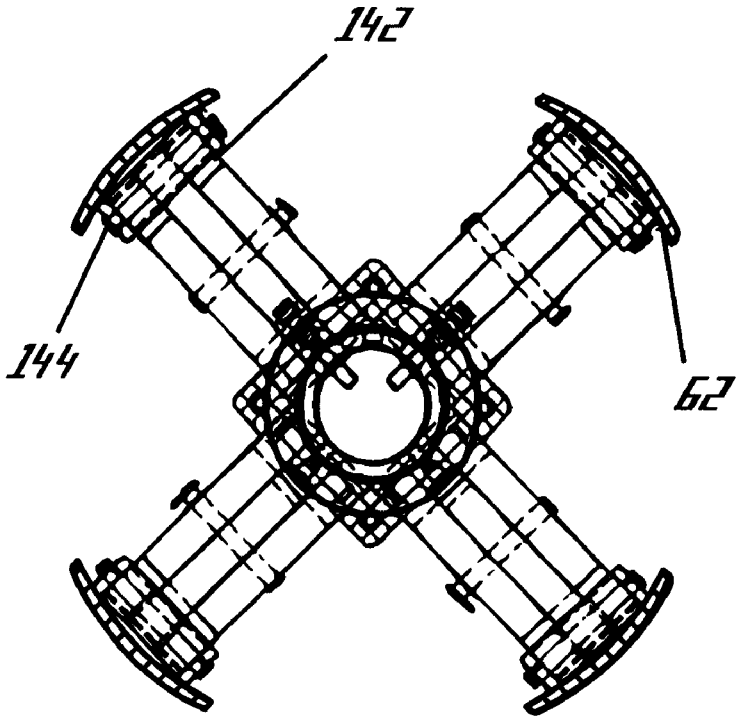
FIG. 5 is a right side elevational view of the clamp assembly shown in FIG. 4.
Figure 9:
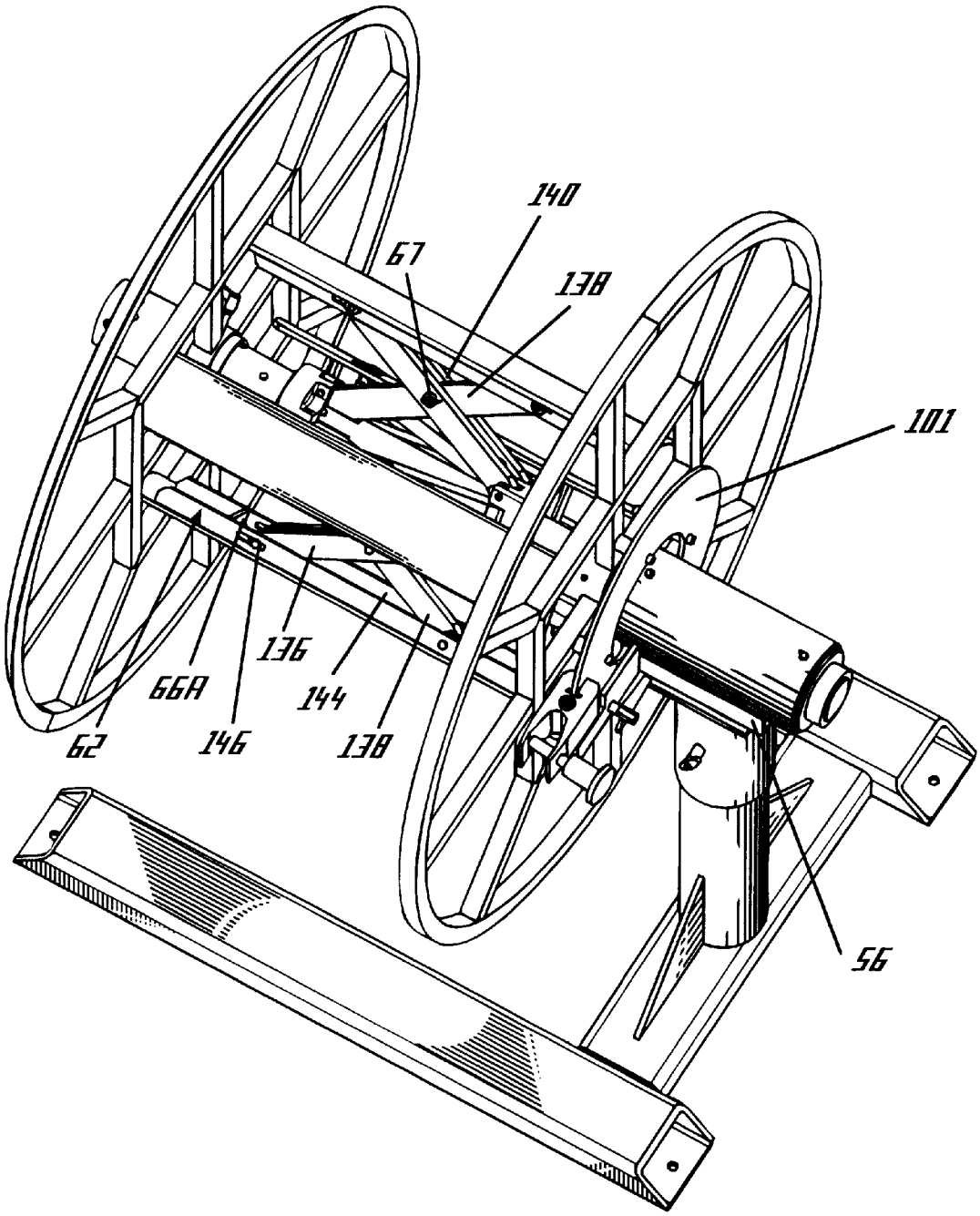
FIG. 9 is a top perspective view of a preferred embodiment of the invention in one of its possible support frame pivot settings.

FIGS. 4, 5 and 9 illustrate undercarriage 62 which is preferably in the form of longitudinally extending, parallel pair of rails 142 and 144 fixed to the undersurface of clamp pads 4, which may be constructed with smooth corners and edges, with added lateral supports 66A (e.g., a pair of bolt/sleeve combinations). This arrangement is well suited for having the undercarriage conform with the curved cross-section of pads 4 which curvature is provided to conform the clamp pads 4 to the interior curved surface of the package to be supported. Various other undercarriage arrangements are also possible such as, for example, a U-shaped cross-section rail for each pad. At least two (and preferably a greater number of holes or slots for extension and contraction range adjustment) are provided in each rail. The holes or slots in the undercarriages are designed to receive an undercarriage pivot shaft such as shaft 146 in FIGS. 4A and 9 of slots are used so the pivot shaft can slide back and forth within the slots about which the radial outer ends of outer links 136 and 140 rotate. The outer radial end of interior link 138 is pivotably connected to the clamp undercarriage 62 by way of shaft 148.

Thus upon a change in relative position of hubs 6 and 7, the scissor link assemblies 68 adjust their position to cause either a contraction or expansion of the clamp pads 4. The combination of the multiple curved outer exteriors of the clamp pads 4 thereby provide a substantially cylindrical configuration upon which the wire coil is firmly retained upon expansion. In one embodiment there are two fixed or four clamp support assemblies equally spaced around the main shaft, however, a greater or lesser number can be utilized if the retention power is sufficient with respect to the type of coil being fixed.

Figure 4C:
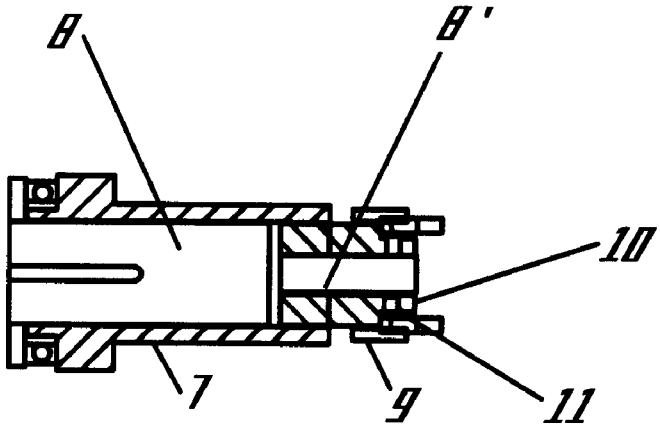
FIG. 4C is a cut away view of the mobile hub, drive screw and locking collar combination of the present invention which is provided on the stepped down end of the main shaft.
Figure 10B:
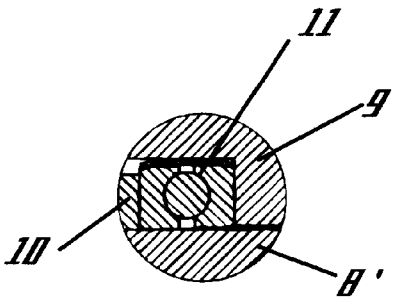
FIG. 10B is a an enlarged view of portion B of FIG. 11A.
Figure 10A:
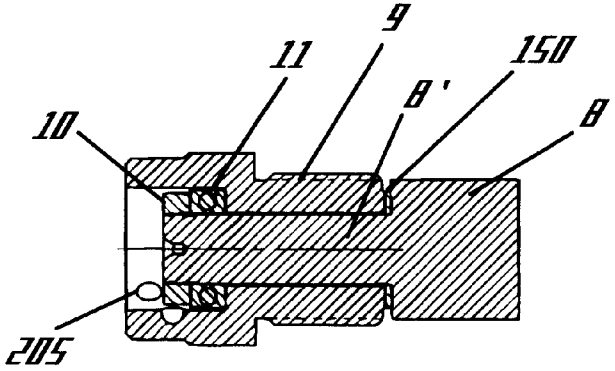
FIG. 10A a is a cross-sectional view taken along cross-section line A—A in FIG. 11.
Figure 10:
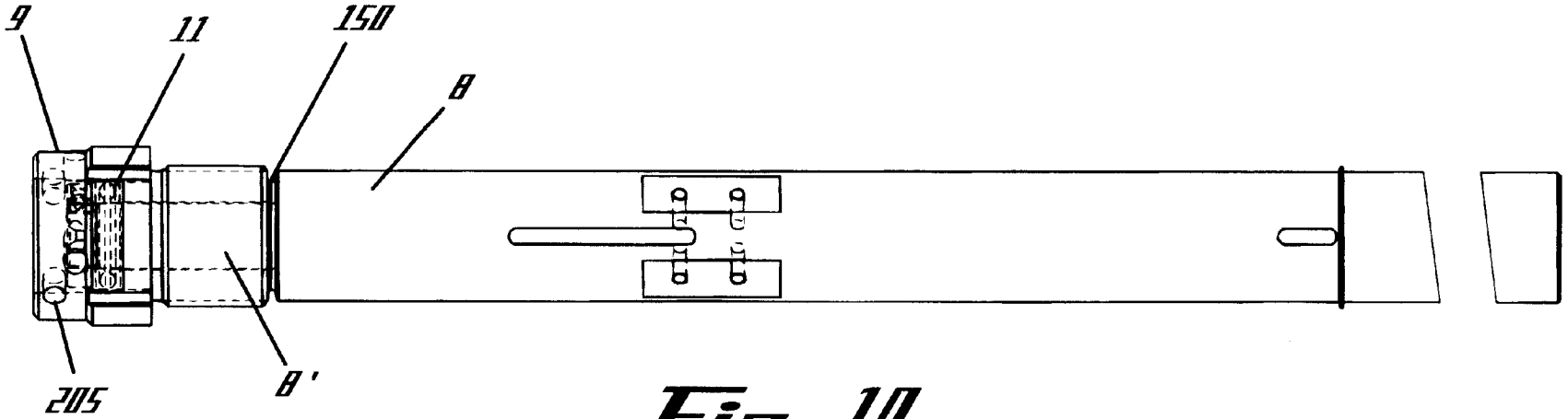
FIG. 10 is a front view showing the connection of the main shaft and drive screw.
Figure 12:
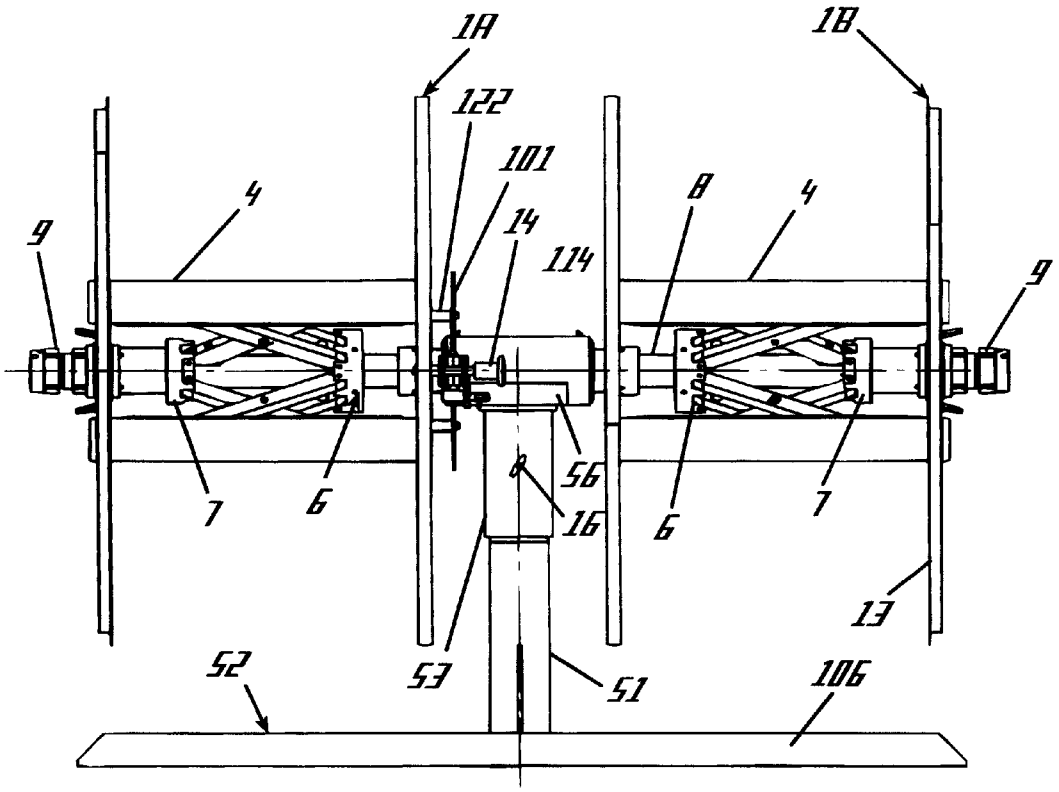
FIG. 12 is a left side elevational view of that which is shown in FIG. 12.
Figure 11:
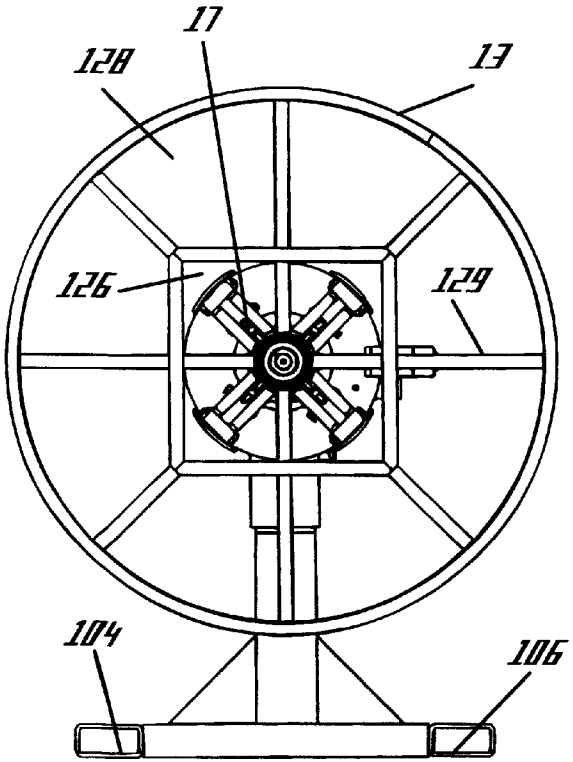
FIG. 11 is a front elevation view of a preferred embodiment of the invention having two clamp assemblies.
Figure 14:
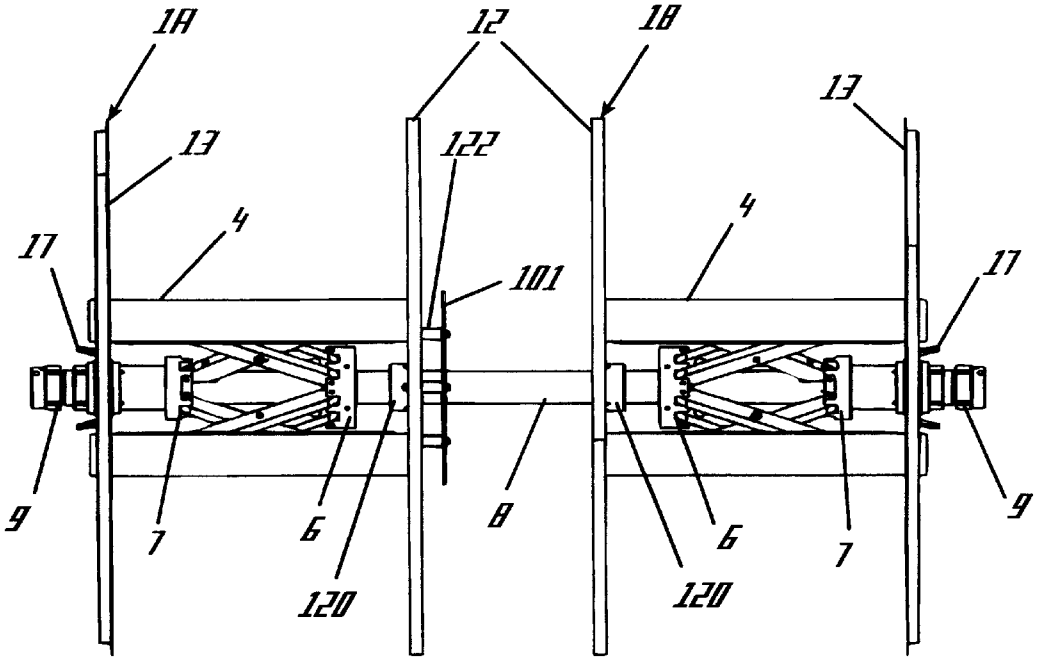
FIG. 14 is a left side elevational view of that which is shown in FIG. 14.
Figure 13:
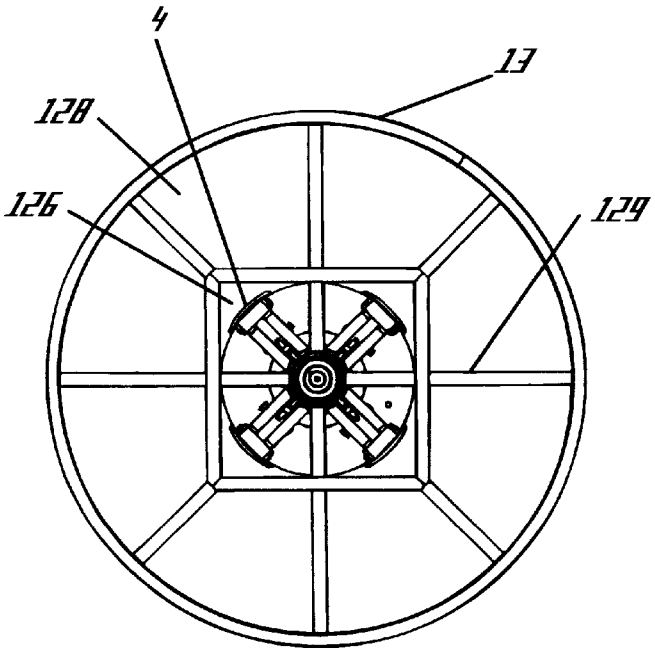
FIG. 13 is a front elevational view of the preferred embodiment of FIG. 12 (the support frame having been removed for added clarity of the clamp assemblies.
Figure 15B:
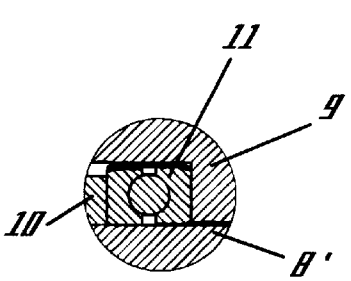
FIG. 15B is a an enlarged view of portion B of FIG. 15A.
Figure 15A:
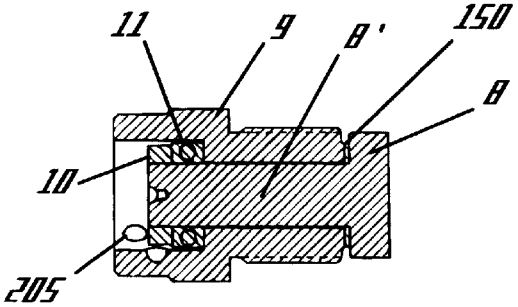
FIG. 15A a is a cross-sectional view taken along cross-section line A—A in FIG. 15.
Figure 15:
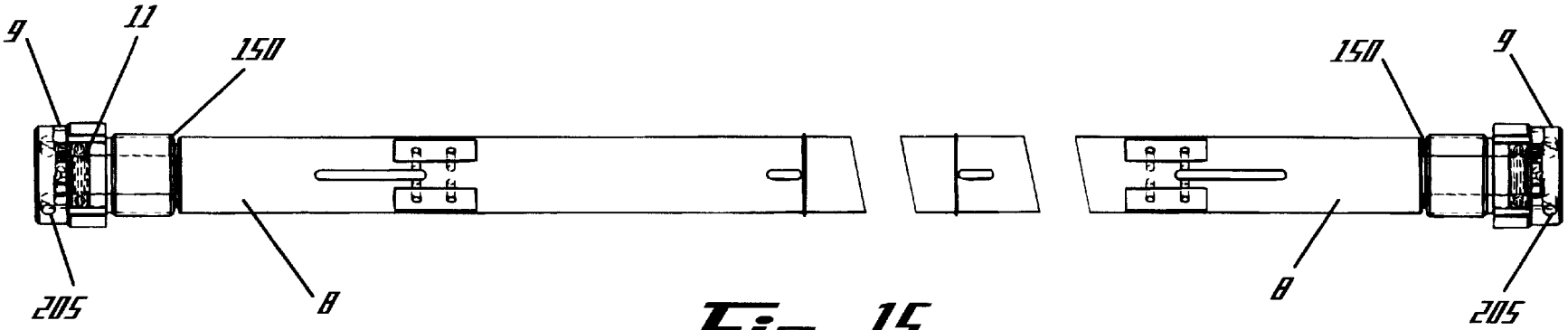
FIG. 15 is a front view showing the connection of the main shaft to the drive screws of the preferred embodiment shown in FIG. 12.

FIGS. 4C and 10 illustrate a preferred driving mechanism for the present invention for the axial adjustment of the mobile hub 7 along main shaft 8 toward or away from the stationary hub 6 to change the relative angle of link members 68 by causing the link members to pivot and thereby drive the clamp support members 62 radially outward such that the clamp pads 4 engage the interior surface of the coiled wire or radially inward to place the clamps in a contracted state. As shown in FIG. 4C, the mobile hub 7 is driven or moved axially along the main shaft by a drive assembly which in a preferred embodiment features a drive screw 9 threadedly connected to the mobile hub. The drive screw 9 preferably has a central through hole which receives smaller diameter end extension 8' of main shaft 8 with the drive screw 9 being held in place axially by locking collar 10 attached to the free end of the main shaft's smaller diameter end extension and stepped shoulder 150 defining the boundary between the larger diameter portion of shaft 8 and the small diameter shaft end extension 8'. As best shown in FIGS. 10A and 10B the drive screw 9 is thus axially retained by the locking collar 10 and stepped shoulder 150, but free to rotate about the main shaft's smaller diameter end extension 8' with the assistance of a thrust bearing 11 provided axially inward of the locking collar. With this arrangement, the mobile hub 7 is also preferably formed as a cylindrical sleeve with a sufficient diameter to receive and axially slide along the larger diameter portion of the main shaft 8 extending to the stepped shoulder 150. In a preferred embodiment, the sleeve of mobile hub 7 (or at least a portion thereof) is provided with interior threads for engagement with the drive screw's external threads such that, upon rotation of the drive screw 9, the mobile hub is moved axially along the main shaft either closer to or away from the fixed hub depending on the direction of rotation of the drive screw and the clamp assembly is correspondingly expanded or contracted.

The removable end plate 13 has a plurality of locking clamps for clamping the plate to the drive screw or main shaft. Thus, the drive screw 9 is turned by placing the removable end plate 13 on the drive screw 9 and locking the locking clamps 17 such that rotation at the removable end plate 13 rotates the drive screw. Following the appropriate degree of clamp pad 4 expansion, the removable end plate 13 can then be released by releasing the locking clamps and shifted axially along the main shaft against the wire coil and again locked into position by way of the locking clamps 17. The removable end plate may be supported by an expanded section of drive screw 9, or by cross hole(s) in the drive screw for insertion of a backing pin, when in the drive screw rotation mode and then shifted onto the mobile hub 7 and fixed to exterior surface 152 of hub 7 through use of clamps 17 with exterior surface 152 preferably having a common sized diameter with respect to the end plate support portion of drive screw 9. Exterior surface 152 has an axial length that is greater than the axial length of the fixed hub 6 and an axial length that is sufficient to provide a wide range of axial adjustment of the removable end plate into its final coil side contact position for handling a wide range of coil widths (e.g., an axial length of from about 25 to 29 inches and preferably 4 inches of axial adjustment to handle a corresponding variation range in coil widths).

Figure 7:
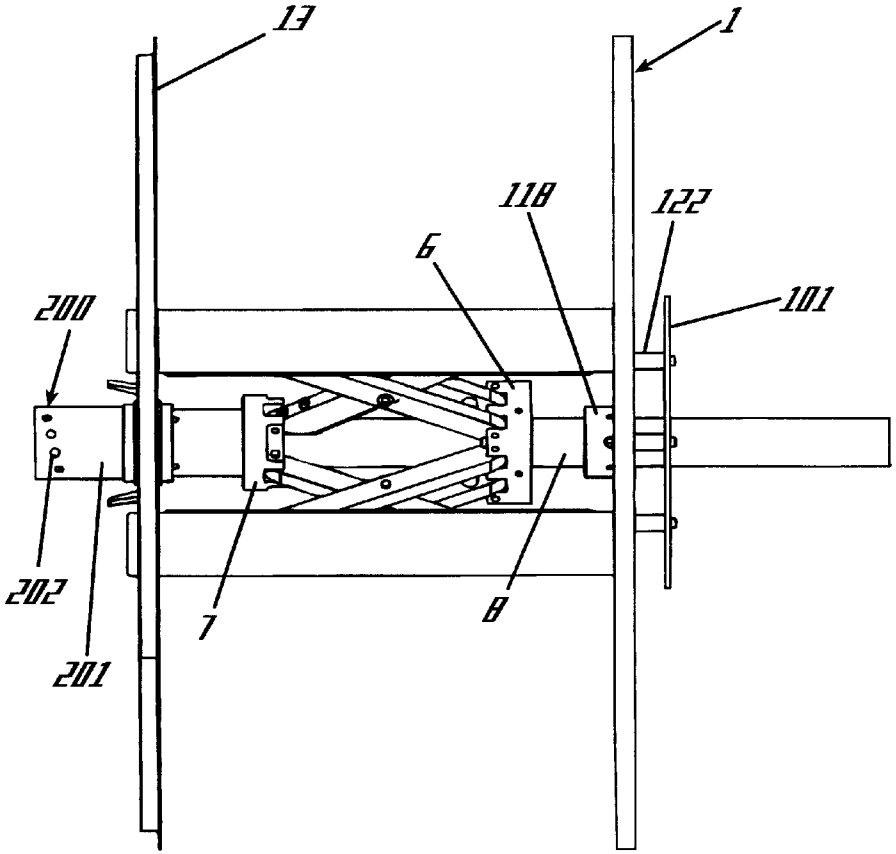
FIG. 7 is a front elevational view of the clamp assembly (the support frame of FIG. 1 having been removed for added clarity of the clamp assembly structure).

A locking collar 200 for the removable end plate 13, as shown in FIGS. 1 and 7, may be used to lock the removeable end plate 13 in place. The locking collar 200 consists of a sleeve 201 having staggered holes 202. The locking collar 200 may be placed on the drive screw 9 and rotated such that a hole 202 in the locking collar aligns with a hole 205 in the drive screw 9 (as best seen in FIG. 10). A locking pin (not shown in the drawing) may then be inserted through a sleeve hole 202 and the drive screw hole 205. The staggered holes 202 allow for the adjustment of the removable end plate 13 to various lateral positions such that proper lateral support may be supplied to coils of different widths. The locking pin may be a cotter pin or some other safety device to prevent the accidental removal of the pin.

In a second preferred embodiment shown in FIGS. 11–15B two clamp assemblies (1A, 1B)are used. In this embodiment the main shaft 8 extends through the opposite sides of the bearing support 114 such that a clamp assembly (1A, 1B) may be mounted on the main shaft 8 on each side of the bearing support 114. In order to provide proper support and balance the bearing support 114 is preferably located at the lateral center of the main shaft 8 such that the shaft and clamp assemblies are symmetrical about a vertical centerline.

In this embodiment, the legs 104 and 106 of base 52 extend in H-shaped fashion to provide sufficient support for both clamp assemblies. The clamp assemblies have separate drive screws 9 and removeable end plates such that each clamp assembly may be adjusted to its particular coil. However, a brake assembly 14 and prongs 122 may be used on only one of the clamp assemblies to provide a stopping means for the main shaft 8.

This embodiment allows for the paying off of two coils of wire. For example, a job may require two different sizes of coil. Instead of needing two separate vehicles (one for each coil), in this embodiment a single vehicle may be used to transport both coils. Furthermore, under this embodiment two different coils of wire may be paid off simultaneously.

When loading the coils on each clamp assembly, the upper part can be rotated for loading a first coil of wire and locked into place. The first coil may then be loaded on the first clamp assembly. The sleeve 53 may then be rotated and locked into a second position for loading of a second coil on the second clamp assembly.

The operation of the payoff device will now be described.

Before loading the wire coil on the device the stop pin 15 is inserted to stop rotation of the clamp assembly 1 to avoid unintended rotation of the clamp assembly and to orient the fixed arms. The removable end plate 13 is then removed from the clamp assembly 1. A coil of wire, such as "Multiplex" Electrical Wire & Cable is then placed onto the clamp assembly by a fork lift, a hook or the like. The removable end plate 13 is then placed onto the drive screw 9 and affixed by locking the locking clamps 17. The removable end plate 13 is then manually rotated thereby turning the drive screw 9 which through its threaded connection to the mobile hub 7 axially moves the mobile hub 7 along the main shaft thereby driving the clamp pads 4 radially outward by the scissors linkage 5 such that the clamp pads 4 contact the inner surface of the wire coil. The removable end plate 13 is then moved against the side of the coil and locking clamps 17 are again tightened such that end plates 12, 13 provide lateral support to the coil.

The coil is then preferably moved into the field by the truck or the like on which the support frame 3 is securely mounted. Once at the location in the field, the brake 14 is then set at an appropriate drag setting (or checked to see if it is already at a desired drag setting) for a desired degree of payoff ease and the stop pin 15 is removed. The wire may then be manually pulled off of the coil. If rotation about the vertical support member is desired, the locating pin 16 may be removed and the upper support frame 53 pivoted with respect to the lower support frame portion 51 and then relocked at the new position. If approximately level the coil can be manually pivoted. No fork lift or the like is required to pivot the 1500 lb coil to a new payoff orientation. Although the present invention has been described with reference to preferred embodiments, the invention is not limited to the details thereof. Various substitutions and modifications will occur to those of ordinary skill in the art, and all such substitutions and modifications are intended to fall within the spirit and scope of the invention as defined in the appended claims.

What is claimed is:

1. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said expansion-contraction assembly includes a mobile hub in driving engagement with said drive mechanism for axial movement along said shaft, and said expansion-contraction assembly further comprising a linkage assembly connected radially inward to said mobile hub and radially externally to said coil clamp means such that an axial shifting of said mobile hub causes a change in radial position in said linkage assembly and connected clamp means; said drive mechanism includes a driver axially fixed in position on said shaft and free to rotate about said shaft and said driver being in driving communication with said mobile hub such that rotation of said driver causes an axial position shift in said mobile hub with respect to said shaft; and said removable end plate is mounted on said driver during driver operation.

2. A payoff device as recited in claim 1, wherein said removable end plate is mounted on said mobile hub during pay off of coil supported by said clamp means.

3. A payoff device as recited in claim 2 wherein said removable end plate is designed for contact with a side surface of a coil supported on said clamp means and said mobile hub has an axially extended end plate support section which is axially greater than the axially thickness of the contacting portion of the removable end plate so as to provide for removable end plate axial adjustments to accommodate different width coils.

4. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said expansion-contraction assembly includes a mobile hub in driving engagement with said drive mechanism for axial movement along said shaft, and said expansion-contraction assembly further comprising a linkage assembly connected radially inward to said mobile hub and radially externally to said coil clamp means such that an axial shifting of said mobile hub causes a change in radial position in said linkage assembly and connected clamp means; said drive mechanism includes a driver axially fixed in position on said shaft and free to rotate about said shaft and said driver being in driving communication with said mobile hub such that rotation of said driver causes an axial position shift in said mobile hub with respect to said shaft; and said removable end plate is mounted on said driver during driver operation; and said shaft has a larger diameter section and a smaller diameter section and a stepped shoulder forming a boundary between said larger and smaller diameter shaft sections, and said payoff device further comprising a retention member supported by the smaller diameter shaft section, and said driver being axially retained between said stepped shoulder and said retention member.

5. A payoff device as recited in claim 4 wherein said driver is a drive screw with external threads and said mobile hub has an internal thread section in threaded engagement with the external threads of said drive screw.

6. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position, wherein said expansion-contraction assembly includes a mobile hub in driving engagement with said drive mechanism for axial movement along said shaft, and said expansion-contraction assembly further comprising a linkage assembly connected radially inward to said mobile hub and radially externally to said coil clamp means such that an axial shifting of said mobile hub causes a change in radial position in said linkage assembly and connected clamp means; and said expansion-contraction assembly further comprises a fixed hub fixedly secured to said shaft, and said mobile hub and shaft are connected by way of a key-slot arrangement such that said mobile hub rotates together with said shaft and is also free to axial shift along said shaft.

7. A payoff device as recited in claim 6 wherein said clamp means includes a plurality of clamp pads circumferentially spaced apart and said linkage assembly includes a plurality of circumferentially spaced scissor link assemblies each having scissor links with radially interior ends pivotably connected to a respective one of said mobile hub and fixed hub and radially exterior ends pivotably connected to a respective one of said clamp pads.

8. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said support frame is arranged so as to support only one end of said shaft which pivots with respect to said support frame and so as to have a supported shaft end section and a free end section and said removable end plate is supported on or closer to said free end section than said supported end section such that a coil of material can be inserted past the free end section and into position on said clamp means.

9. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said support frame includes a pivot section supported by a non-rotating base section, and said pivoting section supports said shaft such that said shaft and pivot section rotate together with respect to said base section; and wherein said pivot section includes a bearing which receives an end of said shaft for rotation of said shaft with respect to said pivot section.

10. A payoff device comprising:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said support frame includes a pivot section supported by a non-rotating base section, and said pivoting section supports said shaft such that said shaft and pivot section rotate together with respect to said base section; and wherein said pivot section includes a bearing casing and a pair of axially spaced bearings for bearing contact with the received end of said shaft and said bearings being spaced axially apart over at least a quarter of a total length of said shaft.

11. A payoff device having:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; further comprising a second end plate which is fixedly connected to said main shaft for contact with an opposite side of a supported coil as that of said removable end plate, and said second end plate supports a brake disc, and said payoff device further comprising a brake component supported by said support frame and in a braking relationship with respect to said brake disc so as to provide a free spinning prevention drag function with respect to a coil supported by said clamp means, and said payoff device further comprising a locking pin which engages with said brake disc to preclude any movement of said clamp means during loading of a coil.

12. A payoff apparatus for uncoiling a reeless package, comprising:

a support frame;

a rotating clamp assembly attached to said frame, said clamp assembly for holding the coil and comprising a rotatable main shaft, a mobile hub connected to said main shaft and movable in an axial direction, a stationary hub connected to said main shaft, and a plurality of clamp pads connected to said mobile hub and stationary hub by a scissor linkage such that the movement of said mobile hub in an axial direction moves the plurality of clamp pads in a radial direction to engage an interior surface of the coil;

a fixed end plate connected to main shaft for laterally supporting the coil; and a removable end plate connected to said main shaft.

13. The payoff apparatus of claim 12 further comprising:

a drive screw threadably connected to said mobile hub such that rotation of the drive screw moves said mobile hub in an axial direction.

14. The payoff apparatus of claim 12 wherein said removable end plate is mounted on said drive screw such that rotation of the removable end plate drives said drive screw and thereby moves said mobile hub in an axial direction thereby moving said clamp pads in a radial direction.

15. The payoff apparatus of claim 12 further comprising a brake for braking against free rotation of said clamp assembly.

16. The payoff apparatus of claim 12 wherein said frame has a pivotal support part, such that said clamp assembly may be rotated about a vertical rotation axis.

17. The payoff apparatus of claim 12 wherein said frame comprises a base section for attachment to the bed of a truck.

18. The payoff device of claim 12 further comprising a brake to prevent unwanted rotation of the main shaft.

19. The payoff device of claim 12 wherein said moveable end plate has locking clamps for attaching said moveable end plate to said driving screw for manual rotation of said drive screw.

20. A payoff device having:

a support frame;

a shaft supported on said support frame;

an expansion-contraction assembly positioned on said shaft;

coil clamp means supported by said expansion-contraction assembly and positioned for coil retention upon expansion of the said expansion-contraction assembly;

a drive mechanism for adjustment in position of said expansion-contraction assembly;

a removable coil retention end plate which is supported by said shaft and extends radial out from said shaft; and a locking device having a first coil retention end plate locking position and a second coil retention end plate release position; wherein said support frame includes a rotatable support part which receives said shaft, and a locating pin for preventing rotation of said rotatable support part following a pivot adjustment.

21. A payoff device for a reeless coil, comprising:

a support frame;

a shaft pivotably supported at one end only by said support frame so as to a free end and a supported end;

a reeless coil support mandrel supported by said shaft;

a coil retention end plate which is supported by said shaft and extends radial out from said shaft;

and said support frame including a bearing support section which receives said supported end of said shaft for rotation of said shaft within said bearing support and a base section, and said bearing support section and said base section being arranged such that said bearing support section is pivotable with respect to said base section so as to provide for different orientations of the free end of said shaft.

22. A payoff device as recited in claim 21 further comprising first and second coil end plates axially spaced apart along said shaft, and the first end plate, which is positioned closer to said free end than said second end plate, includes means for removable mounting of said first end plate so as to provide for insertion of a reeless package axial along said shaft and into contact with said mandrel and axial retention by said first end plate upon remounting with said means for removable mounting.

23. A payoff device as recited in claim 21 wherein said mandrel includes clamp pads and means for expansion and contraction into engagement with a reeless coil and a driver which is drivingly connected with said removable end plate during operation of said expansion-conraction means.

24. A payoff device as recited in claim 21 further comprising locating means for fixing said bearing support section from further rotation following a pivot adjustment of said bearing support section with respect to said base section.

25. A method for payoff of a reeless coil, comprising:

placing a coil of reeless material on to a mandrel supported by a shaft supported by a support framework, which mandrel includes a radial expansion-contraction assembly;

mounting a coil retention end plate on a driver in driving engagement with said expansion-contraction assembly;

rotating said retention end plate to impart rotation to said driver to cause an expansion of said expansion-contraction assembly and to place said mandrel in retention engagement with the reeless coil;

repositioning said coil retention end plate in contact with or closer to contact with the reeless coil retained by said mandrel; and paying out coil material from said coil.

26. The method of claim 25 further comprising pivoting said retained coil about a vertical axis so as to provide a different payout orientation.

27. A method for payoff of a reeless coil, comprising:

placing a coil of reeless material on to a mandrel supported by a shaft supported by a support framework, which mandrel includes a coil retention means, mounting a coil retention end plate on a driver in driving engagement with said coil retention means;

rotating said retention end plate to impart rotation to said driver to place said mandrel in retention engagement with the reeless coil;

repositioning said coil retention end plate in contact with or closer to contact with the reeless coil retained by said mandrel; and paying out coil material from said coil.

* * * * *